US007998280B2

(12) United States Patent
Son

(10) Patent No.: US 7,998,280 B2
(45) Date of Patent: Aug. 16, 2011

(54) METHOD OF CONTROLLING DISHWASHER AND DISHWASHER

(75) Inventor: Ro Mon Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 235 days.

(21) Appl. No.: 12/233,850

(22) Filed: Sep. 19, 2008

(65) Prior Publication Data

US 2009/0078288 A1 Mar. 26, 2009

(30) Foreign Application Priority Data

Sep. 21, 2007 (KR) ..... 10-2007-0096733

(51) Int. Cl.
*B08B 3/02* (2006.01)

(52) U.S. Cl. ..... 134/56 D; 134/56 R; 134/57 D; 134/58 D

(58) Field of Classification Search ..... 134/56 R, 134/57 R, 57 D, 56 D, 113
See application file for complete search history.

(56) References Cited

U.S. PATENT DOCUMENTS 5,681,401 A * 10/1997 Gardner et al. ..... 134/18
6,615,850 B1 * 9/2003 Hornung ..... 134/57 R
2006/0060215 A1 * 3/2006 Lee ..... 134/18

* cited by examiner

*Primary Examiner* — Michael Barr
*Assistant Examiner* — Saeed T Chaudhry
(74) *Attorney, Agent, or Firm* — KED & Associates, LLP

(57) ABSTRACT

A dishwasher and a method of controlling a dishwasher are provided. Using this method of controlling a dishwasher, it is possible to quickly and precisely determine, during the washing of dishes, whether nozzles are clogged with impurities. It is also possible to easily address the problems associated with clogged nozzles by terminating the operation of a washing pump for a predefined amount of time, and then resuming the operation of the washing pump to clear obstructions from the nozzles.

8 Claims, 5 Drawing Sheets

METHOD OF CONTROLLING DISHWASHER AND DISHWASHER

This application claims priority to Korean Patent Application No. 10-2007-0096733 filed in Korea on Sep. 21, 2007, the disclosure of which is incorporated herein by reference in its entirety.

BACKGROUND

1. Field

A dishwasher and a method of controlling a dishwasher are provided, and more particularly, a dishwasher and a method of controlling a dishwasher in which it can be precisely determined whether nozzles are clogged and in which clogged nozzles can be easily cleaned.

2. Background

Dishwashers are devices for washing dishes soiled with food residues by spraying wash fluid onto the dishes. Dishwashers include a washing tub having racks for holding dishes, a fluid supply device supplying clean wash fluid to a sump disposed below the washing tub, a wash fluid spray device spraying the wash fluid supplied into the sump toward the racks so as to clean the dishes, and a drain device discharging waste wash fluid resulting from the washing of the dishes. The wash fluid spray device includes nozzle devices arranged to face the racks and a cleaning pump pumping the wash fluid contained the sump into the nozzle devices. Each of the nozzle devices has a number of nozzles through which wash fluid can be sprayed at high pressure.

The nozzles may easily get clogged with impurities during a dishwashing operation, as wash fluid is recycled in order to reduce the consumption of wash fluid, and recycled wash fluid is highly likely to contain impurities. However, once the nozzles are clogged, the performance of the dishwasher deteriorates. In addition, if impurities that clog the nozzles become rotten, an offensive odor may be emitted from the washing tub. Impurities contained in recycled wash fluid may be filtered out to some extent by providing a filter between the sump and the nozzle device. However, since the performance of the filter is limited, it is almost impossible to completely filter out impurities from wash fluid.

It may be difficult to determine whether the nozzles of a dishwasher are clogged, and thus, it is difficult to address the problems associated with clogged nozzles in a timely manner. In addition, in order to clean the nozzles, the dishwasher may need to be disassembled and then reassembled once the cleaning of the nozzles is complete. Thus, it is very difficult and time-consuming to clean the nozzles.

SUMMARY

A dishwasher and a method of controlling a dishwasher are provided, in which it can be precisely determined whether nozzles are clogged, and in which clogged nozzles can be easily cleaned.

A method of controlling a dishwasher as embodied and broadly described herein may include pumping wash water contained below a washing tub by pumping a washing pump, and washing dishes loaded in the washing tub by spraying the pumped wash water through a plurality of nozzles; and unclogging the nozzles by terminating the operation of the washing pump for a predefined amount of time and then resuming the operation of the washing pump.

A dishwasher as embodied and broadly described herein may include a washing tub in which dishes are loaded and washed; a sump which is disposed below the washing tub and contains wash water; a washing pump which pumps the wash water out of the sump; a plurality of nozzles which spray the wash water pumped by the washing pump onto the dishes; and a control unit which unclogs the nozzles by terminating the operation of the washing pump for a predefined amount of time and then resuming the operation of the washing pump.

In a dishwasher and a method as embodied and broadly described herein, it is possible to quickly and precisely determine, during the washing of dishes, whether nozzles are clogged with impurities contained in wash water. In addition, it is possible to easily address the problems associated with clogged nozzles simply by terminating the operation of a washing pump for a predefined amount of time and then resuming the operation of the washing pump.

Moreover, it is possible to prevent the performance of a dishwasher from deteriorating due to clogged nozzles and to improve user convenience by automatically determining whether there are clogged nozzles during the washing of dishes and unclogging the nozzles if the nozzles are determined to be clogged.

BRIEF DESCRIPTION OF THE DRAWINGS

The above and other features and advantages of embodiments as broadly described herein will become more apparent by describing in detail features thereof with reference to the attached drawings in which.

DETAILED DESCRIPTION

Figure 1:
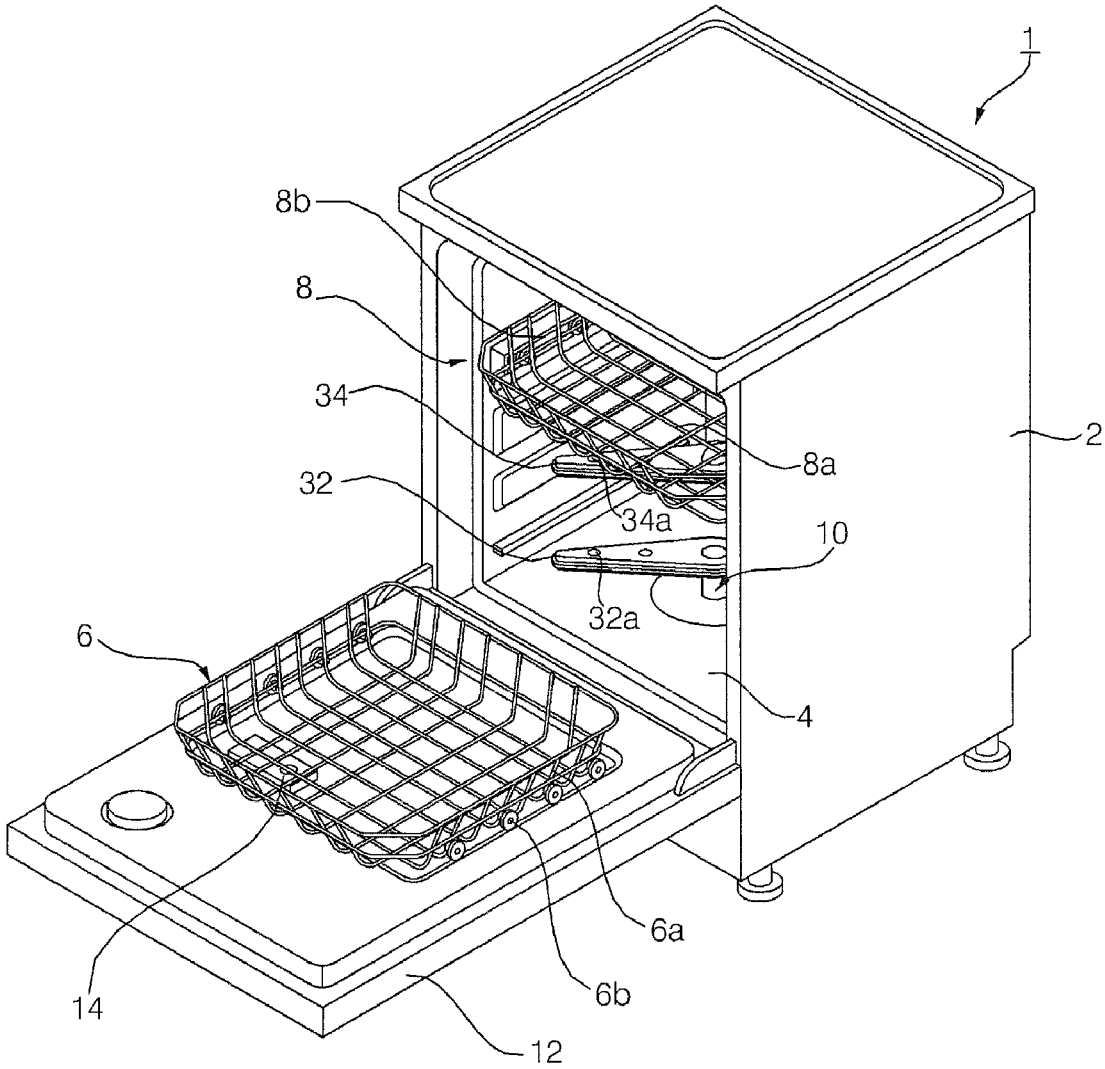
FIG. 1 is a perspective view of an exemplary dishwasher according to an embodiment as broadly described herein.
Figure 2:
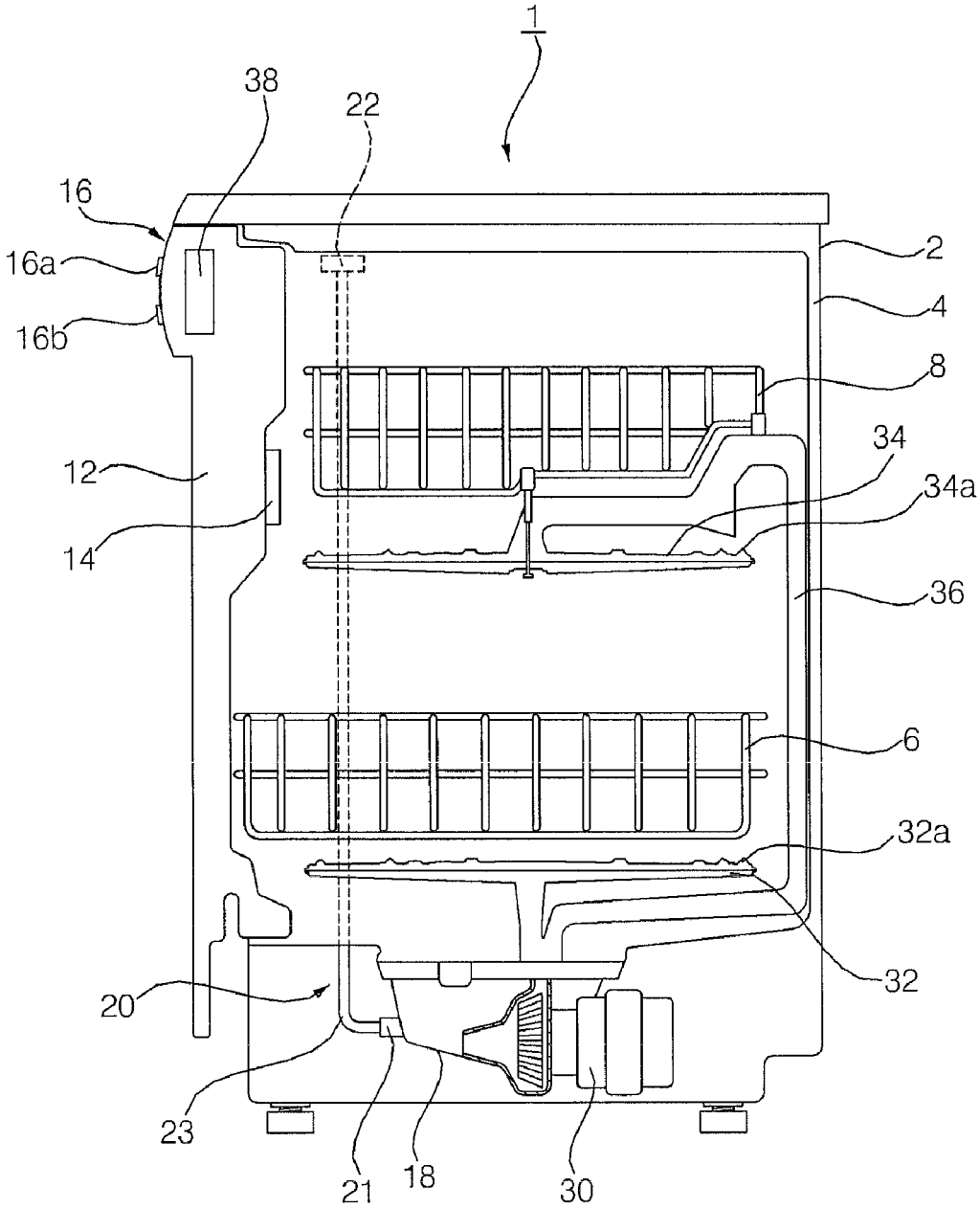
FIG. 2 is a cross-sectional view of the dishwasher shown in FIG. 1.

Referring to FIGS. 1 and 2, a dishwasher 1 includes a cabinet 2, which forms the exterior of the dishwasher 1, a washing tub 4, which is disposed in the cabinet 2 and has a space for washing dishes loaded therein, a plurality of rack assemblies 6 and 8, which are movably disposed in the washing tub 4 to hold dishes, and a wash fluid spray device 10, which is disposed in the washing tub 4 and sprays wash fluid onto dishes held by the rack assemblies 6 and 8.

Each of the cabinet 2 and the washing tub 4 has an opening at the front, and thus, dishes can be loaded onto the rack assemblies 6 and 8 in the tub 4 through the openings of the cabinet 2 and the washing tub 4. A door 12 is disposed so as to be able to open or close the cabinet 2, for example, in a drop-down manner. A detergent supply device 14 is disposed on a rear surface of the door 12 to supply detergent into the washing tub 4. A manipulation device 16 is disposed at an upper part of the front of the door 12 to allow a user to control the operation of the dishwasher 1. The manipulation device 16 includes a plurality of switches 16*a* and 16*b*. The user may choose and set a dishwashing program by manipulating one of the switches 16*a* and 16*b*.

Figure 3:
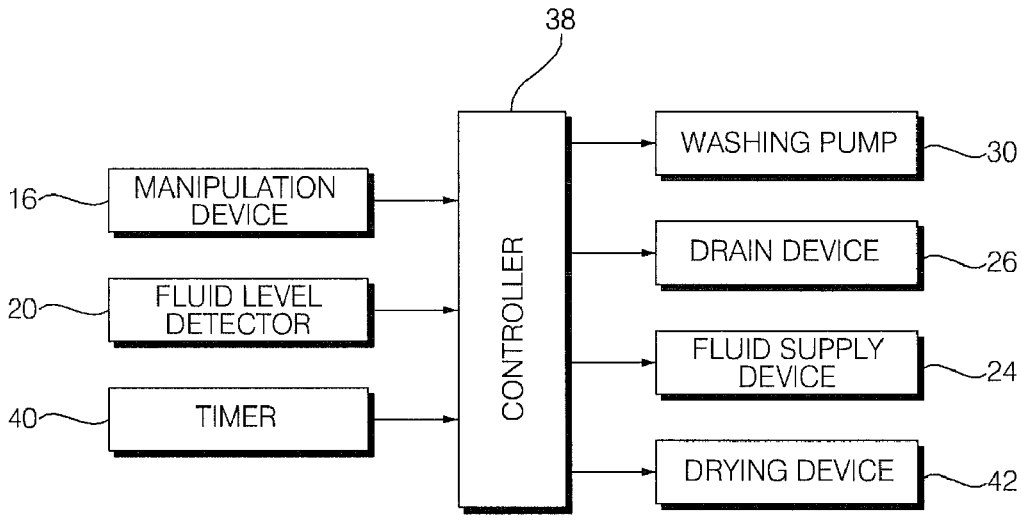
FIG. 3 is a block diagram of the dishwasher shown in FIG. 1.

Referring to FIGS. 2 and 3, a sump 18 is disposed below the washing tub 4. The sump 18 contains wash fluid. A heating device (not shown) is disposed in the sump 18 and heats the wash fluid contained in the sump 18. A sheath heater having excellent watertight properties may be used as the heating device. A water level detector 20 is disposed below the sump 18. The water level detector 20 includes an air chamber 21, which is connected to a lower part of the sump 18 and is filled with air, a pressure sensor 22, which is disposed above the sump 18, and an air hose 23, which connects the pressure sensor 22 and the air chamber 21 and transfers wash fluid contained in the sump 18 to the pressure sensor 22 with the use of air. As the fluid level in the sump 18 increases, the pressure applied on air in the air chamber 21 by the wash fluid contained in the sump 18 increases. On the other hand, as the fluid level in the sump 18 decreases, the pressure applied on air in the air chamber 21 decreases. A variation in the air pressure in the air chamber 21 is transmitted to the pressure sensor 22 by the air in the air hose 23. The pressure sensor 22 may detect the fluid level in the sump 18 based on a variation in the air pressure in the air chamber 21.

Referring to FIG. 3, a fluid supply device 24 is connected to a first side of the sump 18. The fluid supply device 24 supplies clean wash fluid provided by an external source into the sump 18. A drain device 26 is connected to a second side of the sump 18. The drain device 26 discharges wash fluid used to clean dishes from the dishwasher 1. The fluid supply device 24 includes a fluid supply path (not shown) connecting the first side of the sump 18 to the external source and a fluid supply valve (not shown) disposed on the supply path. The supply of wash fluid into the sump 18 may be controlled by opening or closing the supply valve. The drain device 26 includes a drain path (not shown) disposed between the second side of the sump 18 and the outside of the dishwasher 1 and a drain pump (not shown) disposed on the drain path. The wash fluid contained in the sump 18 may be pumped out of the dishwasher 1 by the drain pump.

Referring to FIGS. 1 and 2, the rack assemblies 6 and 8 include a first rack assembly 6 disposed in a lower part of the washing tub 4 so as to be able to be withdrawn from the washing tub 4 and a second rack assembly 8 disposed in an upper part of the washing tub 4 so as to be able to be withdrawn from the washing tub 6. The first rack assembly 6 includes a first rack 6*a* and a plurality of wheels 6*b*. The first rack 6*a* is disposed in the washing tub 4 such that both lateral sides of the first rack assembly 6 can slide along corresponding inner surfaces of the washing tub 4. The first rack 6*a* may hold dishes therein. The wheels 6*b* are disposed under the first rack 6*a* and roll along the bottom surface of the washing tub 4 and the rear surface of the door 12. The second rack assembly 8 includes a second rack 8*a* and guide rails 8*b*. The second rack 8*a* is disposed above the first rack 6*a* and may hold dishes therein. The guide rails 8*b* are disposed on both sides of the second rack 8*a* and support the second rack 8*a* so that the second rack 8*a* can move back and forth.

Referring to FIGS. 1 and 2, the wash fluid spray device 10 includes a washing pump 30, which is connected to the sump 18 and pumps wash fluid into the sump 18, a plurality of nozzle devices 32 and 34, which spray the wash fluid pumped by the washing pump 30 onto the dishes held by the first and second rack assemblies 6 and 8, and a wash fluid flow path 36, which is formed between the washing pump 30 and the nozzle devices 32 and 34. The nozzle devices 32 and 34 include a first nozzle device 32, which is rotatably disposed below the first rack 6*a* and sprays wash fluid onto the dishes held by the first rack 6*a*, and a second nozzle device 34, which is rotatably disposed below the second rack 8*a* and sprays wash fluid onto the dishes held by the second rack 8*a*.

The first nozzle device 32 includes a plurality of first nozzles 32*a*, which are formed on the top surface of the first nozzle device 32 and face the first rack 6*a*. Likewise, the second nozzle device 34 includes a plurality of second nozzles 34*a*, which are formed on the top surface of the second nozzle device 34 and face the second rack 8*a*. Thus, when wash fluid is pumped out of the sump 18 by the washing pump 30, the wash fluid flows into the first and second nozzle devices 32 and 34 through the wash fluid flow path 36, and is sprayed onto the dishes held by the first and second racks 6*a* and 8*a* at high pressure.

Referring to FIGS. 2 and 3, a controller 38 is disposed at the door 12 or the cabinet 2. The controller 38 controls the operation of the dishwasher 1. The controller 38 includes a timer 40, which measures the operating time of the dishwasher 1. In the exemplary embodiment of FIGS. 1 through 3, the controller 38 may be disposed in an upper part of the door 12. A drying device 42 is disposed between the cabinet 2 and the washing tub 4 and supplies dry air into the washing tub 4. The drying device 42 includes a blower, which blows external air into the washing tub 4 and discharges air from the washing tub 4, and a heater, which heats air injected into the washing tub 4 by the blower.

A method of controlling the dishwasher 1 shown in FIGS. 1-3 will hereinafter be described in detail.

The door 12 is pulled down so as to open the washing tub 4, and the first and second racks 6*a* and 8*a* of the first and second rack assemblies 6 and 8 are withdrawn from the washing tub 4. Thereafter, dishes are placed on each of the first and second racks 6*a* and 8*a*, and the first and second racks 6*a* and 8*b* are put back in the washing tub 4. Thereafter, the door 12 is closed so as to close the washing tub 4.

Thereafter, a washing program is chosen by manipulating the manipulation unit 16 at the door 12, and the dishwasher 1 is operated. The chosen washing program is input to the controller 38, and the controller 38 controls the operation or the dishwasher 1 according to the chosen washing program.

Figure 4:
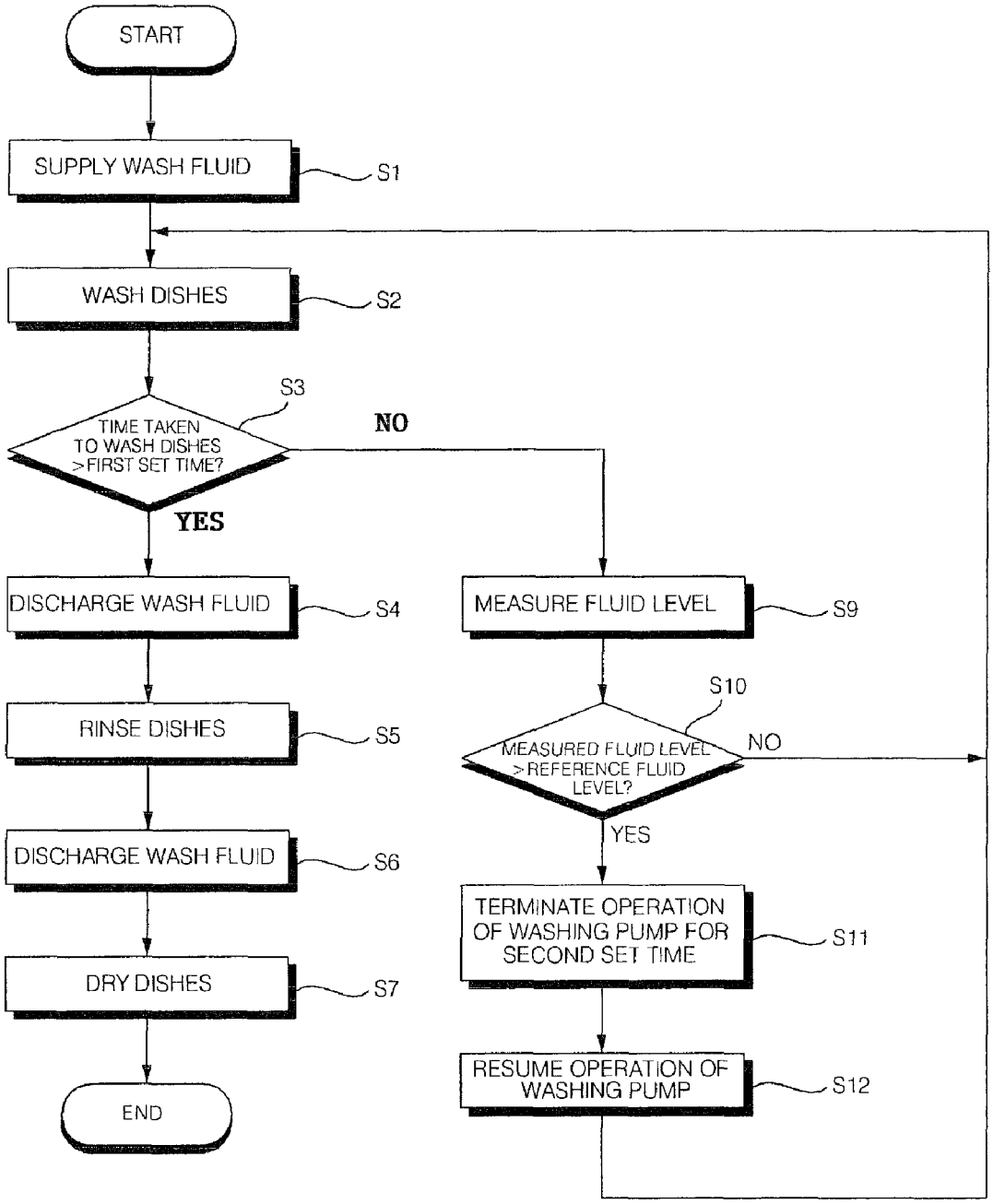
FIG. 4 is a flowchart of a method of controlling a dishwasher according to an exemplary embodiment as broadly described herein.

Referring to FIG. 4, the controller 38 drives the fluid supply device 24 and thus supplies clean wash fluid into the sump 18 (S1). If wash fluid is supplied into the sump 18 to a predefined water level, the operation of the water supply device 24 is terminated, and a washing operation is performed on the dishes by driving the heating device in the sump 18 and the wash water spray device 10. More specifically, the wash water contained in the sump 18 is sprayed onto the dishes by the wash water spray device 10. The heating device heats the wash water in the sump 18, thereby improving the dishwashing performance of the wash water spray device 10. During operation S2, detergent may be supplied into the washing tub 4 by driving the detergent supply device 14.

Once the washing operation is complete, the controller 38 compares the time taken to wash the dishes with a first set time (S3). If the time taken to wash the dishes is greater than the first set time, the controller 38 terminates the operations of the heating device and the spray device 10, and drains the sump 18 by driving the drain device 26 (S4). Thereafter, the controller 38 drives the supply device 24 and thus supplies clean wash fluid again into the sump 18. Then, the controller 38 drives the spray device 10 and thus rinses the dishes with clean wash fluid (S5). During the rinsing of the dishes, the wash fluid used to rinse the dishes may be heated by driving the heating device, and a rinsing agent may be supplied into the washing tub 4 by driving the detergent supply device 14.

Once the rinsing of the dishes is complete, the controller 38 terminates the operations of the heating device and the spray device 10, and drains the sump 18 by driving the drain device 26 (S6). Thereafter, the controller 38 supplies hot air into the washing tub 4 by driving the drying device 42 (S7). As a result, the dishes in the washing tub 4 are dried by the hot air.

Thereafter, the controller 38 terminates the operation of the drying device 42, and thus, the operation of the dishwasher 1 is complete.

If the time taken to wash the dishes is less than the first set time, the controller 38 measures the fluid level in the sump 18 (S9) and compares the measured fluid level to a reference fluid level to determine whether the first nozzles 32*a* and the second nozzles 34*a* are clogged (S10). If the measured level is greater than the reference level, it is determined that the first nozzles 32*a* and/or the second nozzles 34*a* are clogged, the controller 38 terminates the operation of the washing pump 30 for a second set time (S11) and then resumes the operation of the washing pump 30 in order to unclog the first nozzles 32*a* and/or the second nozzles 34*a* (S12).

More specifically, if the fluid level in the sump 18 exceeds a reference fluid level (S10), the controller 38 determines that the first nozzles 32*a* and/or the second nozzles 34*a* are not allowing adequate flow of fluid therethrough and thus are clogged. The reference fluid level may be a level at which neither the first nozzles 32*a* nor the second nozzles 34*a* are clogged.

That is, if none of the first nozzles 32*a* and the second nozzles 34*a* are clogged and the wash fluid spray device 10 operates normally, the fluid level in the sump 18 may gradually decrease due to the consumption of wash fluid by the spray device 10. Thus, the reference fluid level may be a lowest fluid level in the sump 18 due to the consumption of the wash fluid by the spray device 10. If some of the first nozzles 32*a* and/or the second nozzles 34*a* are clogged, the amount or wash fluid sprayed through the first nozzles 32*a* and the second nozzles 34*a* may decrease. Thus, the fluid level in the sump 18 may be higher than the reference level because of a reduction in the amount of wash fluid consumed by the spray device 10.

If the fluid level in the sump 18 exceeds the reference level, the controller 38 terminates the operation of the washing pump 30 for the second set time (S11), and then resumes the operation of the washing pump 30 (S12), thereby removing impurities that clog the first nozzles 32*a* and the second nozzles 34*a* with high-pressure wash fluid as the operation of the washing pump 30 is re-initiated (S12).

Thereafter, the method returns to operation S2. If the impurities that clog the first nozzles 32*a* and the second nozzles 34*a* are not completely removed by operations S11 and S12, operations S11 and S12 may be performed again. During operation S2, it may be continuously monitored whether the first nozzles 32*a* and the second nozzles 34*a* are clogged. Operations S11 and S12 may be performed repeatedly until the fluid level in the sump 18 decreases below the reference water level.

Figure 5:
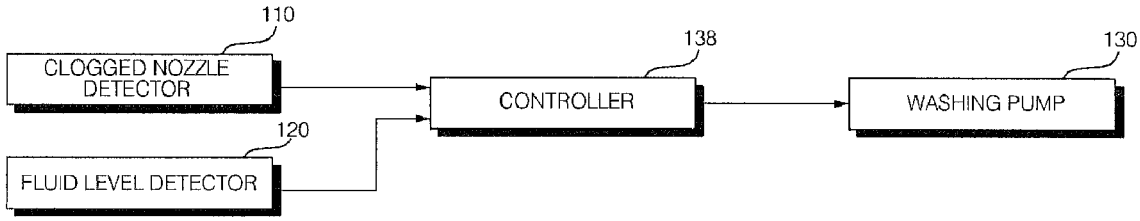
FIG. 5 is a flowchart of a method of controlling a dishwasher according to another exemplary embodiment as broadly described herein.

FIG. 5 is a block diagram of a dishwasher according to another exemplary embodiment. Referring to FIG. 5, the dishwasher includes a washing tub, which holds dishes therein and contains wash fluid, a washing pump 130, which pumps the wash fluid out of the washing tub 4, a plurality of nozzles, which spray the wash fluid pumped by the washing pump 130 onto the dishes, and a controller 138, which terminates the operation of the washing pump 130 for a predefined amount of time and then resumes the operation of the washing pump 130 in order to unclog the nozzles as necessary. The dishwasher may also include a clogged nozzle detector 110, which detects clogged nozzles during the washing of the dishes in the tub by the washing pump 130. If the clogged nozzle detector 110 determines that the nozzles are clogged, the controller 138 terminates the operation of the washing pump 130 for the predefined amount of time and then resumes the operation of the washing pump 130. More specifically, the clogged nozzle detector 110 determines whether the nozzles are clogged, and transmits a sensing signal indicating whether the nozzles are clogged to the controller 138. If the sensing signal indicates that the nozzles are clogged, the controller 138 terminates the operation of the washing pump 130 for the predefined amount of time and then resumes the operation of the washing pump 130, thereby removing impurities that clog the nozzles.

The dishwasher may also include a fluid level detector 120, which is disposed below the washing tub and measures the fluid level in the washing tub. In this case, if a measured fluid level provided by the fluid level detector 120 exceeds a reference fluid level, the controller 138 may determine that the nozzles are clogged. The operation of the controller 138 when it is determined that the nozzles are clogged, the controller 138 is the same as that described above with reference to FIGS. 3 and 4, and thus, a detailed description thereof will be omitted. The reference fluid level may be a level at which none of the nozzles are clogged. The controller 138 may terminate and then resume the operation of the washing pump 130 more than one time until the nozzles are completely unclogged. Therefore, it is possible to prevent dishes from being improperly cleaned due to clogged nozzles. In addition, it is possible to effectively clean dishes by periodically monitoring whether there are clogged nozzles and cleaning clogged nozzles.

Any reference in this specification to "one embodiment," "an embodiment," "example embodiment," "certain embodiment," "alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher, comprising:

a tub that receives items to be washed;

a sump positioned below the tub, wherein the sump receives and stores wash fluid;

a pump that pumps the wash fluid from the sump;

a plurality of nozzles that receive wash fluid from the pump and spray the received wash fluid onto the items received in the tub;

a fluid level detector that measures a fluid level in the sump; and a controller that controls operation of the pump, wherein the controller determines that one or more of the plurality of nozzles are clogged if the measured fluid level in the sump exceeds a reference fluid level in a selected cycle and terminates operation of the pump for a first predefined amount of time and then resumes operation of the pump in the selected cycle after the first predefined amount of time has elapsed when the controller determines that one or more of the plurality of nozzles are clogged.

2. The dishwasher of claim 1, wherein the reference fluid level is a level at which fluid flows from the sump unobstructed through the plurality of nozzles.

3. The dishwasher of claim 1, further comprising:

a manipulation device that receives input of a wash cycle selection and outputs a corresponding signal to the controller; and a timer that measures elapsed time of a plurality of segments of the selected wash cycle and outputs a corresponding signal to the controller, wherein the controller controls operation of the pump, a fluid supply device, a drain device and a drying device based on the signals received from the manipulation device and the timer.

4. The dishwasher of claim 3, wherein, if an amount of time taken to complete a segment of the selected wash cycle is less than or equal to a predetermined set time for the segment, the controller controls operation of the pump, the fluid supply device, the drain device and the drying device to proceed to a subsequent segment of the selected wash cycle.

5. The dishwasher of claim 3, wherein, if an amount of time taken to complete a segment of the selected wash cycle is greater than a predetermined set time for the segment, the controller compares the measured fluid level in the sump to the reference fluid level to determine if one or more of the plurality of nozzles are clogged.

6. The dishwasher of claim 5, wherein, if the controller determines that one or more of the plurality of nozzles are clogged, the controller repeatedly terminates operation of the pump for the first predefined amount of time and then resumes operation of the pump for a second predefined amount of time, until the measured fluid level in the sump is less than or equal to the reference fluid level.

7. The dishwasher of claim 1, wherein the controller repeatedly terminates operation of the pump for the first predefined amount of time and thereafter resumes operation of the pump until the fluid level in the sump measured by the fluid level detector is less than or equal to the reference fluid level.

8. The dishwasher of claim 1, wherein the controller terminates operation of the pump for the first predefined amount of time so as to temporarily suspend performance of a current wash cycle, and resumes operation of the pump after the first predefined amount of time has elapsed so as to resume performance of the current wash cycle.

* * * * *